United States Patent [19]

Courtoy

[11] 4,247,353

[45] Jan. 27, 1981

[54] MANUFACTURE OF A COMPOSITE COVERING

[75] Inventor: Jean-François Courtoy, Wiltz, Luxembourg

[73] Assignee: Eurofloor S.A., Wiltz, Luxembourg

[21] Appl. No.: 17,857

[22] Filed: Mar. 6, 1979

[30] Foreign Application Priority Data

Mar. 7, 1978 [LU] Luxembourg ..... 79184

[51] Int. Cl.[3] ..... B05D 3/02

[52] U.S. Cl. ..... 156/277; 427/246; 427/258; 427/261; 427/265; 427/373; 427/374.2; 428/159; 428/172

[58] Field of Search ..... 156/277, 79, 384; 428/156, 172, 159-161, 158; 427/261-262, 265, 258, 246, 373, 374 A

[56] References Cited

U.S. PATENT DOCUMENTS

| | | | |
|---|---|---|---|
| 3,905,849 | 9/1975 | Bomboire | 156/79 |
| 4,017,658 | 4/1977 | Bomboire | 156/79 X |

*Primary Examiner*—David A. Simmons

*Attorney, Agent, or Firm*—Fishman and Van Kirk

[57] ABSTRACT

Textured sheet material is produced by a process which includes two printing steps and two separate applications of plastisol in the form of discontinuous layers. The plastisol layers are applied over respective of the printed patterns and the first layer of plastisol is gelled, but not fused, prior to the second printing step which provides an image thereon. The process enables production of a relief pattern having "valleys" of two different depths.

10 Claims, 3 Drawing Figures

MANUFACTURE OF A COMPOSITE COVERING

BACKGROUND OF THE INVENTION (1) Field of the Invention

The present invention relates to an improved process for the manufacture of coverings made of synthetic materials, particularly floors coverings.

2. Description of the Prior Art

U.S. Pat. No. 4,017,658 describes a process for producing a textured or relief surface on printed sheet material comprising the following steps:

printing an ornamental pattern on the sheet material;

application of a transparent plastisol in at least one discontinuous intermediate layer on the pattern thus printed; and passing the resulting assembly through a fusing oven.

The reliefs obtainable by the process of U.S. Pat. No. 4,017,658 are comparatively thin and the decorative effects provided by the combination of the printed pattern and the relief are also limited.

SUMMARY OF THE INVENTION

The present invention provides a process for producing textured decorative sheet material having more satisfactory properties, particularly as regards the thickness of the relief, when compared to the prior art. The present invention also improves the decorative characteristics, of the comfort provided by and the more profitable use of such texturized sheet material.

The process covered by the present invention is characterized by the following operational steps:

initial printing of an ornamental pattern on a support, application of a discontinuous plastisol, which may include an expansion or foaming agent, over the printed pattern in a thickness of at least 100$\mu$ by a serigraphic method, gelling of the plastisol by exposure to an elevated temperature sufficient to cause coagulation, but lower than the decomposition temperature of any expansion agent which has been included in the plastisol, cooling and smoothing by causing the product to pass between two cylinders of the type used in embossing machines, a second printing in at least two colours, fusing of the plastisol and expansion of the foaming agent, if present.

The process of the present invention also includes the application, by the serigraphic method, of a second plastisol, which may be transparent, in registration with the second printing. The second plastisol application is performed prior to the fusing step. The present invention differs from the prior art by the possible inclusion of an expansion agent in the plastisol and by the treatment adopted for the support before it undergoes the heliographic printing operation. The present invention may also be distinguished from the prior art by the application, in registration with the pattern defined by the second printing, of a transparent non-continuous plastisol.

The support on which the initial printing operation is carried out is preferably a vinyl film having a backing or coating on the surface opposite to that on which the pattern is printed. Alternately, the support may consist of paper.

The initial printing is preferably a relatively simple colour printing effected by the heliographic method in one or two colours.

The application of the non-continuous plastisol by a serigraphic method, following the initial printing operation, is preferably carried out so as to apply the plastisol in registration with the pattern produced by the initial printing. However, the plastisol may also be deposited at random in relation to the initially printed pattern. If a foamable plastisol i.e., a plastisol including an expansion agent is employed; the plastisol is normally opaque and coloured and may partly cover the initial printing. The serigraphic technique (also called screen application technique) which is employed makes it possible to apply accurately an ornamental decoration with patterns of far larger size than those of the initial printing and with very clearly defined outlines. These patterns may for example resemble ceramic tiling with cement jointing (the ceramic part taking the form of floortile shoped as squares, lozenges etc.)

After the fusing and smoothing, a product is obtained which will then preferably be further processed in accordance with the technique described in the aforementioned patent, i.e. by the printing of another ornamental pattern (superimposed on that obtained by the first printing and by the discontinuous first layer of plastisol) by means of a second printing operation and the subsequent of a transparent plastisol in a discontinuous layer on the said other printed pattern.

It has been found that by suitably regulating the machines and provided that the successive operations according to the invention are carried out in one single installation of which the various machines are driven synchronously, it becomes possible to apply the second printing, which is preferably a heliographic printing, selectively to the zones covered by the initial application of plastisol.

The second printing, preferably carried out by the heliographic method, is effected in at least two colours and generally in four colours.

The choice of the expansion agent to be used in the foamable plastisol will depend on the temperatures obtained in the gelling oven and in the fusing and final expansion oven in order to ensure that no foaming will take place during the gelling step. The expansion agent can be selected without difficulty by one skilled in the art.

By way of illustration, a suitable foamable plastisol composition for gelling at a temperature of 100° to 150° C. and fusing at a temperature of 170° to 220° C. is indicated below:

PVC: 100
Mixture of plasticizers (phtalate): 30 to 80
Kicker stabilizer (barium, cadmium): 1 to 4
Epoxide plasticizers: 0 to 5
Azodicarbonamide: 1.5 to 5
Mineral charge (chalk): 0 to 40
Various pigments: 0 to 10

Reference may be had to U.S. Pat. No. 4,017,658 for a disclosure of operating conditions for the first and second heliographic printings and the application of a discontinuous transparent plastisol by a serigraphic technique. The present invention also includes the possibility of combining, with these techniques, the application of a wear layer, either before or after the material has passed through the final fusing oven.

Needless to say, the product obtained by the process described above can be lined, either before the stages of the process covered by the invention or after these operations, in particular by applying a backing. Such backing may consist, for example, of a calendered sheet, asbestos felt or glass fibres, a woven or non-woven support etc.

The invention will be described below by reference to an example in which the first and second printing operations are carried out by the heliographic method. It should be noted, however, that the different operational steps can be modified or varied as necessary or desirable in accordance with the decorative effect or relief required. It is also possible to adopt additional steps or to repeat some of the existing steps. All these variants are within the scope of the invention.

BRIEF DESCRIPTION OF THE DRAWING

In the attached drawing an installation enabling the process of the invention to be carried out is shown schematically in FIG. 1 while crosssectional views of two possible products are illustrated in FIGS. 2 and 3.

DESCRIPTION OF THE PREFERRED EMBODIMENT

Figure 1:
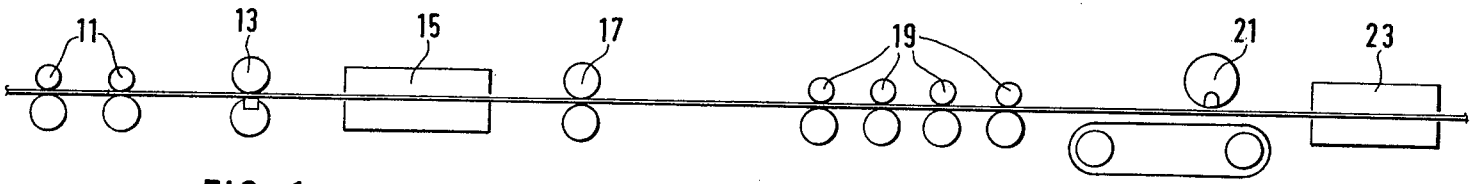

Referring to FIG. 1, an initial printing of a substrate is performed at station 11 which may comprise a two-colored heliographic printing device. A foamable non-continuous layer of plastisol is subsequently applied to the printed substrate, for example by means of a serigraphic technique, at a printing or screening station 13. The plastisol may, for example, have the following composition:

PVC 100
Mixture of plasticizers (phthalate): 60
Kicker stabilizer (barium, cadmium): 2
Epoxide plasticizer: 3
Azodicarbonamide: 3
Mineral charge (chalk): 25
Various pigments: 5

After passing through a gelling oven 15, heated to a temperature of 140° C., the product passes between two cooling and smoothing cylinders. After cooling and smoothing the product undergoes four-colour printing operation, at printing station 19 which is followed by the application of a transparent noncontinuous layer of a plastisol at station 21. The plastisol may have the following composition:

Copolymer of vinyl acetate: 100
Plasticizers (modified phthalates): 36
Plasticizers (butyl benzyl phthalate): 12
Epoxidized soya oil: 5
Stabilizers (tin base): 2
Surfactant: 3

The treated product finally enters a fusing and expansion oven 23 heated to a temperature of 200° C.

Figure 2:
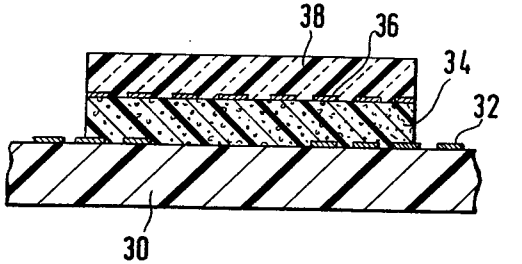
Figure 3:
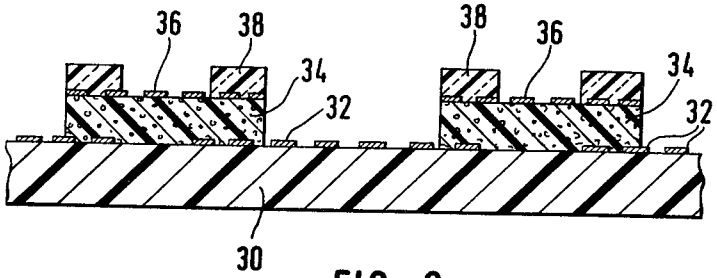

In FIGS. 2 and 3 the opaque elements of the textured sheet material produced in accordance with the present invention are shown hatched, while the coloured printed elements are shown by thick black strokes. On the support 30 an image 32 is shown, this having been produced by means of heliographic printing cylinders at station 11. A layer of a foamable opaque plastisol 34, applied at station 13, partly overlies the image 32. A four-colour image 36 obtained at the heliographic printing station 19 overlies the plastisol 34.

In FIG. 3 the deposit of the transparent plastisol 38 has been shown as covering a numbering of "studs" in the second heliographic impression 36, but it is naturally possible for a "stud" 38 to be provided absolutely in accordance with a serigraphic "stud" 36.

The various proportions expressed in the foregoing tables refer to parts by weight.

The process covered by the invention offers a certain number of advantages unobtainable with the techniques of the state of the art.

In the first place it is possible to provide a double heliographic impression combined with a relief. The first heliographic impression or image 32 is produced in the recessed portions or valleys of the textured product while the second image is provided on the raised portions of the relief pattern. By selecting suitable patterns and specific effects for the two impressions it is possible to produce original decorative patterns, particularly in imitations of shiny tiling or squares with variable local pigmentations, similar to the pigmentations of ceramics.

The first heliographic impression will typically be put in registry with the layer of possibly foamable plastisol deposited by the screen application method. Thus, first heliographic printed layer is deposited in registry with the printed patterns, in such a way as to coincide with the discontinuous layer of plastisol, rather than being at random, there being a certain fixed position assigned to each part of the support for the respective deposits. In this case particular effects can be obtained by the choice of characteristics for the first impression but more particularly by incorporating in a silk printing paste a suitable substance for the production of little bubbles in the transparent or semi-transparent paste, resulting in an iridescence with printing above it, enabling ceramics to be imitated still more effectively.

The last heliographic head of the machine used for the first printing operation can be used for the application of a wear layer. By applying a transparent plastisol, after the second printing operation, by the screen application method in accordance with the technique described, it is possible to obtain a contrast between glossy peaks and matt recesses.

If the image 32 is combinable with the rest of the patterns, no particular precaution has to be taken to prevent overflowing when depositing an opaque foamable plastisol layer 34. Accordingly, the productivity of the installation is improved. Any such overflowing which may occur merely manifests itself in a certain irregularity in the pattern of the opaque layer 34 which may actually enhance the product since such irregularities lend the appearance of the irregularities in the dimensions of the joints between actual tiles.

Similarly, owing to the fact that the second heliographic image is printed only on the raised portions of the relief pattern, a certain amount of overflow in this step can be accepted since there is no need to perform any printing operation in the recesses. A technique of this kind would not be practicable with a screen printing process, which does not include any scraping of the cylinder at each turn in order to take up the material which has overflowed, thus resulting in the production of burr.

Previous techniques, comprising the local printing of an "inhibitor", suffer the drawback that the relief was in most cases imprecisely defined. The process provided by the present invention, on the other hand, enables a well defined relief characterized by two levels to be obtained.

An unexpected advantage of the present invention is the fact that a precisely located printing may be applied over the peaks of the relief produced by the plastisol which has only undergone a gelling, i.e. a coagulated product not having the mechanical properties required for use of the product as floor covering but an intermediate which is sufficiently stable to be handled.

The term "gelling" is well known in the art and, as has been said above for PVC based plastisol, gelling takes place at a temperature in the range of 100°-150° C.

Similarly the term "fusing" is also usual in the art and relates to a true fusion which, after cooling gives a product having physical properties as may be requested for a floor covering. For a PVC based plastisol fusing takes place at a temperature of 170°-220° C., and when a suitable expansion agent is choosen, it is possible at said temperatures to simultaneously foam the plastisol.

It should however be noted that by including in the PVC based plastisol a copolymer of vinyl chloride with another olefin, it is possible to lower both the gelling and the fusing temperature by some ten or even more °C.

The process of this invention is particularly of interest when producing floor coverings in a continuous process, as it allows the performance of successive operations which result in decorative effects which would otherwise not be obtainable.

Although the invention has been specifically described by reference to particularly preferred versions of the process it should be understood that numerous variants and modifications can be adopted by the technician in this field, all of them remaining within the scope of the present invention.

I claim:

1. A process for the manufacture of decorative sheet material characterized by a textured surface comprising the steps of:

printing an ornamental pattern on a substrate;

serigraphically applying a discontinuous layer of plastisol in a thickness of at least 100$\mu$ over the printed pattern;

causing the discontinuous layer of plastisol to gel by passing the substrate through an oven and maintaining the oven temperature at a level which will cause the plastisol to coagulate but will not result in fusing of the plastisol;

cooling the substrate subsequent to removal from the gelling oven;

printing a second pattern on the gelled plastisol in at least two colors; and passing the substrate through a further oven to fuse the plastisol.

2. The method of claim 1 wherein the plastisol includes an expansion agent and wherein the step of causing the plastisol to gel includes maintaining the temperature in the gelling oven below the decomposition temperature of the expansion agent whereby decomposition of the expansion agent and foaming of the plastisol will occur during the step of fusing.

3. The method of claim 1 further comprising:

applying a second discontinuous layer of plastisol over and at least partly in registration with the second printed pattern prior to fusing.

4. The method of claim 2 further comprising:

applying a second discontinuous layer of plastisol over and at least partly in registration with the second printed pattern prior to fusing.

5. The method of claim 4 wherein the step of printing an ornamental pattern on the substrate comprises subjecting the substrate to a heliographic printing process.

6. The method of claim 4 wherein the step of serigraphically applying the first discontinuous layer of plastisol includes depositing the plastisol on the substrate in registration with the pattern printed thereon.

7. The method of claim 4 wherein the steps of printing comprise:

subjecting the substrate to a heliographic printing process.

8. The method of claim 5 wherein the step of serigraphically applying the first discontinuous layer of plastisol includes depositing the plastisol on the substrate in registration with the pattern printed thereon.

9. The method of claim 7 wherein the step of serigraphically applying the first discontinuous layer of plastisol includes depositing the plastisol on the substrate in registration with the pattern printed thereon.

10. The method of claim 1 further comprising:

applying a second discontinuous layer of plastisol over and at least partly in registration with the second printed pattern prior to fusing.

* * * * *